US008284005B2

(12) United States Patent
Yamamoto et al.

(10) Patent No.: US 8,284,005 B2
(45) Date of Patent: Oct. 9, 2012

(54) INDUCTIVE COMPONENT AND METHOD FOR MANUFACTURING THE SAME

(75) Inventors: Kenichi Yamamoto, Osaka (JP); Michio Ohba, Osaka (JP); Nobuya Matsutani, Osaka (JP)

(73) Assignee: Panasonic Corporation, Osaka (JP)

( * ) Notice: Subject to any disclaimer, the term of this patent is extended or adjusted under 35 U.S.C. 154(b) by 90 days.

(21) Appl. No.: 12/681,703

(22) PCT Filed: Oct. 28, 2008

(86) PCT No.: PCT/JP2008/003056

§ 371 (c)(1),
(2), (4) Date: Apr. 5, 2010

(87) PCT Pub. No.: WO2009/057276

PCT Pub. Date: May 7, 2009

(65) Prior Publication Data

US 2010/0219925 A1 Sep. 2, 2010

(30) Foreign Application Priority Data

Oct. 31, 2007 (JP) ..... 2007-282696

(51) Int. Cl.
*H01F 27/02* (2006.01)

(52) U.S. Cl. ..... 336/83

(58) Field of Classification Search ..... 336/65, 336/83, 192, 200, 206–208, 232
See application file for complete search history.

(56) References Cited

U.S. PATENT DOCUMENTS

| | | | | |
|---|---|---|---|---|
| 6,194,248 | B1 * | 2/2001 | Amaya et al. | 438/110 |
| 6,956,455 | B2 * | 10/2005 | Tokuda et al. | 336/83 |
| 7,106,161 | B2 * | 9/2006 | Tozawa et al. | 336/200 |
| 7,495,538 | B2 * | 2/2009 | Tsunemi et al. | 336/84 M |
| 7,663,464 | B2 * | 2/2010 | Yamamoto et al. | 336/205 |
| 2001/0017420 | A1 | 8/2001 | Iwao et al. | |

FOREIGN PATENT DOCUMENTS

| | | |
|---|---|---|
| JP | 09-186042 | 7/1997 |
| JP | 10-097942 | 4/1998 |
| JP | 2001-244116 | 9/2001 |
| JP | 2003-110397 | 4/2003 |
| JP | 2005-317604 | 11/2005 |
| JP | 2006-324492 | 11/2006 |
| WO | WO 2007/072617 A1 | 6/2007 |

* cited by examiner

*Primary Examiner* — Tuyen Nguyen
(74) *Attorney, Agent, or Firm* — McDermott Will & Emery LLP

(57) ABSTRACT

An inductance component is disclosed. This inductance component includes base made of insulating material, coil section buried in base, and external electrode terminals electrically coupled to the ends of coil section. Stress buffering section is provided on the exposed interface between base and external electrode terminals, and this stress buffering section can ease the stress produced by the difference in thermal coefficients due to temperature changes. The foregoing structure thus allows improving the reliability of the inductance component with respect to a thermal shock.

13 Claims, 6 Drawing Sheets

INDUCTIVE COMPONENT AND METHOD FOR MANUFACTURING THE SAME

RELATED APPLICATIONS

This application is the U.S. National Phase under 35 U.S.C. §371 of International Application No. PCT/JP2008/003056, filed on Oct. 28, 2008, which in turn claims the benefit of Japanese Application No. 2007-282696, filed on Oct. 31, 2007, the disclosures of which Applications are incorporated by reference herein.

TECHNICAL FIELD

The present invention relates to a chip-component, more particularly an inductance component, to be used in electronic devices such as portable telephones, and it also relates to a method of manufacturing the same inductance component.

BACKGROUND ART

A chip-component, typically an inductance component, has been known as a ceramic electronic component which is made by this method: Electrodes made of silver or copper excellent in electrical conductivity are formed inside a ceramic base by using a printing technique, and then the ceramic base is fired. FIG. 12 shows a sectional view of the foregoing conventional inductance component, which is manufactured this way in order to achieve a compact body and high accuracy: Insulating base 25 in which coil section 21 is formed by using a plating technique and a photolithographic technique, and external electrode terminals 23, 24 are connected to the ends of coil section 21.

The chip inductance component discussed above has been strongly required to be downsized and have a high Q factor. To achieve these targets, it is important to increase the number of layers of coil section 21 or raise a space factor of a conductive section. Patent literature 1 discloses how to achieve these targets.

The conventional structure discussed above needs more layers of coil section 21 in order to increase an inductance value as well as a greater space factor in order to achieve a higher Q factor. However, when the chip inductance component with a structure achieving the targets is mounted onto a circuit board, a deflection stress of the circuit board due to a temperature change is applied concentrically to external electrode-terminals 23, 24. The insulating material of base 25 is thus subject to the stress, and the soldered joints tend to be cracked.

Patent Literature 1: Unexamined Japanese Patent Publication No: 2005-317604

DISCLOSURE OF THE INVENTION

The present invention aims to provide an inductance component that has better reliability on soldered joints with respect to changes in temperature such as a thermal shock, where the reliability is not affected by the number of layers or the space factor. The present invention also provides a method of manufacturing the same inductance component.

The inductance component of the present invention comprises the following structural elements: an insulating base, a coil section buried in the base, external-electrode terminals electrically coupled to the ends of the coil section, and a stress buffering section provided on an exposed interface between the base and the external-electrode terminals.

The method of manufacturing the inductance component allows the stress buffering section provided around the external-electrode terminals to mitigate the warping caused by internal stress of the inductance component per se. The internal stress is produced by heating and cooling during the soldering for mounting the component and is caused by the number of layers of coil patterns or a space factor of the conductive section. The stress buffering section can also ease an external stress caused by the warping of the circuit board, where the warping is produced by the difference between thermal expansion coefficients when the component is mounted onto the circuit board. The stress supposed to concentrate on the coil section formed in the base thus can be dispersed. The foregoing structure can prevent the stress from breaking the coil section, also from peeling parts of the coil off the interface between the coil and the base. As a result, a compact chip inductance component having a greater number of layers or a greater space factor of the coil section is obtainable, and the practical reliability of the inductance component can be improved.

| Descriptions of Reference Signs | |
|---|---|
| 1 | base |
| 20 | coil section |
| 20a | coil pattern |
| 3, 30 | via electrode |

-continued

| Descriptions of Reference Signs | |
|---|---|
| 4a, 40a | first external electrode terminal |
| 4b, 40b | second external electrode terminal |
| 5, 15 | external electrode terminal |
| 6 | stress buffering section |
| 10 | substrate |
| 11 | epoxy resin |
| 12 | sacrificial layer |
| 13 | copper electrode pattern |
| 14 | space |

BEST MODE FOR CARRYING OUT THE INVENTION

Embodiment 1

An inductance component and a method of manufacturing the same component in accordance with the first embodiment of the present invention are demonstrated hereinafter with reference to the accompanying drawings.

Figure 1:
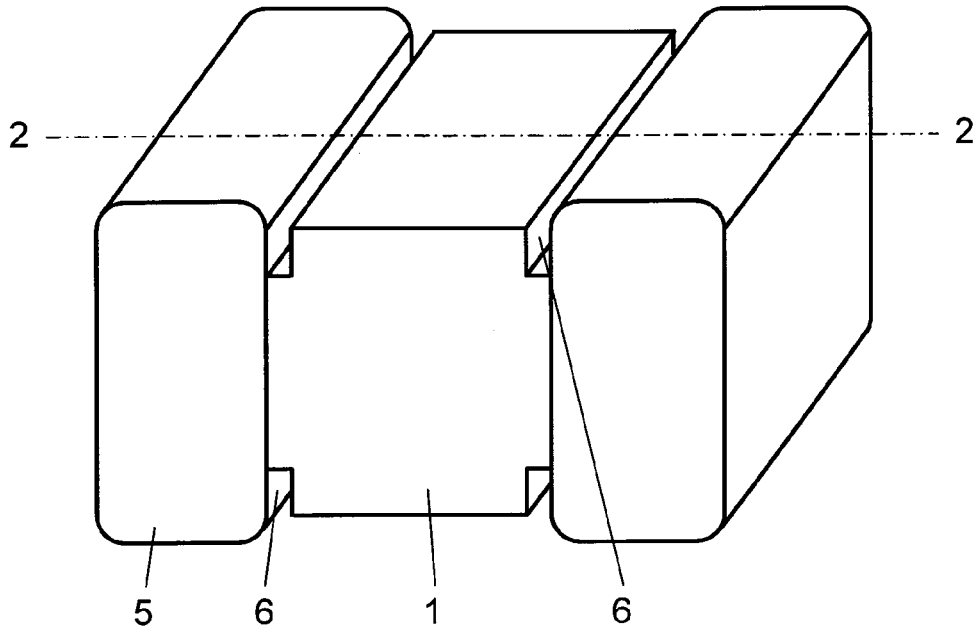
FIG. 1 shows a perspective view of an inductance component in accordance with a first embodiment of the present invention.
Figure 2:
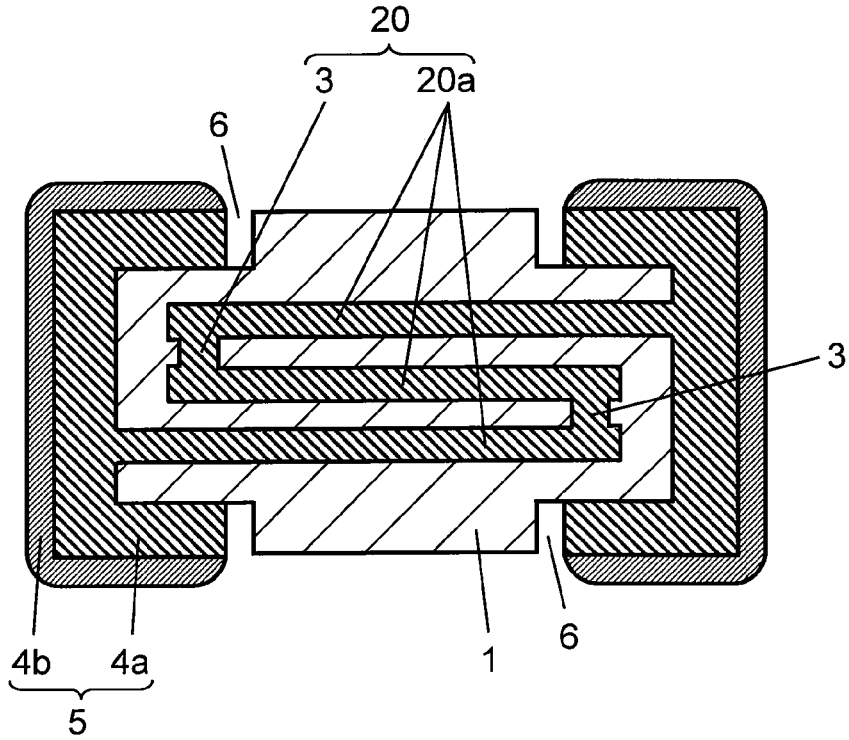
FIG. 2 shows a sectional view cut along line 2-2 in FIG. 1.

FIG. 1 shows a perspective view of the inductance component in accordance with a first embodiment of the present invention. FIG. 2 shows a sectional view cut along line 2-2 in FIG. 1. Coil section 20 is formed this way: Coil patterns 20*a* are layered spirally through via-electrodes 3 by using a plating technique and a photolithographic technique in base 1 formed of insulating resin which is made by curing photosensitive resin.

Via-electrodes 3 correspond to interlayer connecting sections of coil patterns 20*a*. Coil patterns 20*a* formed of multiple layers are spirally or coil-likely connected to each other through via-electrodes 3 formed at given places. In this structure, a greater number of layers of coil patterns 20*a* will increase the inductance value, and a greater sectional area of coil patterns 20*a* will increase a value of the Q factor. A greater space factor, i.e. a greater occupation ratio of conductive section, will allow the inductance component to be downsized.

Coil pattern 20*a* can be in any form such as spiral, coil, meander. Coil pattern 20*a* spirally formed is coupled to first external electrode 4*a* at its both ends. Electrode 4*a* is covered with second external electrode 4*b* excellent in soldering wettability of solder or tin so that first external electrode 4*a* can be well mounted to a connection terminal of a circuit board. External electrode terminal 5 is formed of first external electrode 4*a* and second external electrode 4*b*.

A space having a given empty space is provided on the exposed interface between external electrode terminals 5 and base 1, and the space works as stress buffering section 6. The presence of stress buffering section 6 allows elastic deformation to buffer the warping produced by the difference in the thermal expansion coefficients of the inductance component per se or the circuit board when the component is soldered onto the board. As a result, the foregoing structure prevents coil section 20 from being adversely affected by the stress, and increases the mounting reliability, as a whole, of a chip component. Use of insulating and photosensitive resin as a material of base 1 of the inductance component allows base 1 to elastically deform more readily, so that the stress can be eased without increasing the internal stress.

For instance, in the case of using glass-epoxy, which is generally used as the material of circuit boards, its thermal expansion coefficient is approx. 15 ppm/° C., while that of the inductance component in accordance with this first embodiment is approx. 50 ppm/° C. Thus when a temperature difference of 100-200° C. is generated, the internal stress over 1 GPa can be produced in a conventional inductance component, having no stress buffering section 6, when the component is soldered onto the circuit board.

Stress buffering section 6 is provided along the exposed interface between external electrode terminals 5 and base 1, so that the internal stress, specifically the internal stress applied to the coil section which dominates the performance of the inductance component, can be substantially eased.

Stress buffering section 6 exerts its ability to ease the stress when it is placed at the lower section of the inductance component, i.e. a place facing to the circuit board when it is mounted to the circuit board, because the heaviest stress is applied to this lower section when the component is soldered to the circuit board. The lower section refers to as the face confronting the circuit board when the component is mounted onto the circuit board. Providing stress buffering sections 6 on both sides, i.e. on the top face and on the underside of the inductance component, allows exerting the ability to ease the stress to the maximum extent.

The structure discussed above allows improving greatly the reliability with respect to the thermal shock to the inductance component of the present invention. During the heat treatment in the manufacturing steps of the inductance component, or in a case where the heat generated in a device, in which this component is mounted, the heat travels to this inductance component, and the stress buffering section 6 can buffer the stress, thereby achieving high reliability. As shown in FIG. 2, stress buffering sections 6 are preferably in a shape substantially parallel with the interface so that the effect of buffering the stress can be obtained not in a local area but in a greater area.

Stress buffering section 6 having a substantially V-shaped cross section prevents moisture and corrosive gas from entering base 1, and a greater frontage of the V-shape allows easing the stress to the inductance component. Stress buffering section 6 having a substantially U-shaped cross section prevents the stress from concentrating to one spot because of no angular sections available, so that the inductance component free from origins of mechanical fracture is obtainable.

Stress buffering section 6 can be also formed by filling the space with the material having elasticity, i.e. buffer material. In this case, since no space is available, humidity and corrosive gas cannot enter base 1, so that the reliability of the inductance component can be further increased. The material to be filled is preferably elastomer resin such as silicone resin, acrylic resin, polyethylene resin, and rubber.

The structure discussed previously can also prevent cracks conventionally generated at solder fillet, where the cracks are produced due to the differences in thermal expansion coefficients between the circuit board and the inductance component when the component is soldered to the circuit board. This advantage allows not only prolonging the life of the inductance component per se but also extending the life of the electronic circuit, to which the inductance component is mounted, and increasing the reliability.

Use of polymeric material among other as base 1 will produce the greater advantage. In general, electrode material such as copper, copper alloy, or silver excellent in electric conductivity is used as coil section 20 and external electrode terminal 5. For instance, use of copper as electrode material for coil section 20, where the elastic coefficient of copper is approx. 130 GPa, while polymeric material, e.g. epoxy resin, is used as base 1 of which elastic coefficient is usually approx. a few GPa. The presence of stress buffering section 6 on the interface between external electrode terminal 5 and base 1 allows the inductance component to deform with ease. In other words, the stress buffering section 6 effectively eases the internal stress.

An inductance component desirable to be downsized can achieve a greater inductance value within a limited volumetric capacity only by increasing the number of layers of coil section 20. To achieve a greater value of the Q factor and a smaller DC resistance, it is essential to enlarge the cross sectional area of the electrode pattern forming the inductance. A greater space factor of the conductor in the inductance component is needed to achieve these targets.

Figure 3:
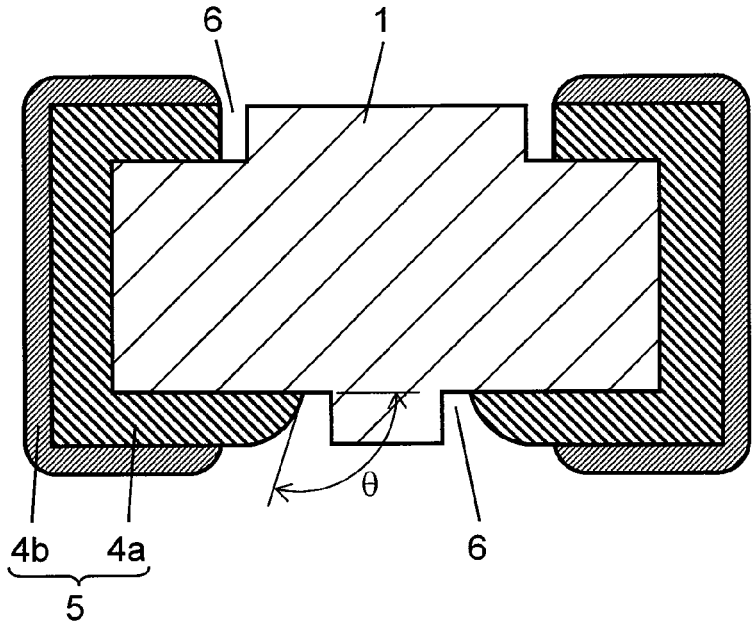
FIG. 3 shows another sectional view of the inductance component in accordance with the first embodiment.

FIG. 3 shows another sectional view of the inductance component in accordance with the first embodiment. As shown in FIG. 3, angle θ is preferably an obtuse angle, where angle θ is included between the side of external electrode terminal 5, where the side confronts stress buffering section 6, and the surface shape of stress buffering section 6. This structure allows easing the stress generated at the soldered place and caused by the difference in thermal expansion coefficients between the circuit board and the inductance component soldered onto the circuit board. The mounting reliability of the inductance component of the present invention can be thus improved. In FIG. 3 coil section 20 is omitted. In a case where external electrode terminal 5 has a cross section of an arcing slope confronting stress buffering section 6, this structure will ease the stress generated on the interface between the soldered place and the second external electrode 4*b*, where the stress is caused by the difference in thermal expansion coefficients between the circuit board and the inductance component soldered onto the circuit board. The mounting reliability of the inductance component of the present invention can be thus improved. As a result, a highly reliable electronic circuit can be manufactured. Use of both obtuse angle θ and an arcing slope in cross section of external electrode terminal 5 will increase the effect of easing the stress.

A method of manufacturing this inductance component in accordance with the first embodiment is detailed with reference to FIG. 4-FIG. 11 which show sectional views illustrating the method of manufacturing the inductance component.

Figure 4:
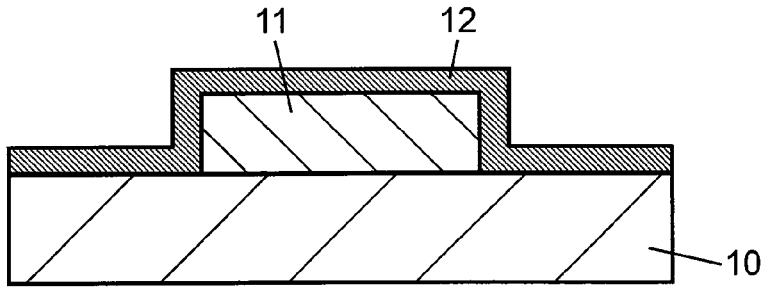
FIG. 4 shows a sectional view illustrating a method of manufacturing the inductance component in accordance with the first embodiment.

First, as shown in FIG. 4, apply epoxy resin 11, i.e. material for base 1, onto substrate 10 that is a base carrier for manufacturing the inductance component. Silicon wafer is preferably used as substrate 10 from the standpoints of shape, productivity, and availability.

Epoxy resin 11 having photosensitivity can be developed and processed into a desirable shape by using the general purpose photolithographic technique. In this embodiment, the lower most layer of the inductance component, i.e. the mounting surface confronting the circuit board, is formed. Then form sacrificial layer 12, which can be removed in a later step, by using a spattering method or an evaporating method. Electrically conductive metal is preferably used as the material for sacrificial layer 12, namely, the preferable material is the electrode material for external electrode terminal 5 and coil section 20, or selectively removable material. To be more specific, titan is a preferable material for this sacrificial layer 12, and other metal materials such as nickel or aluminum can be also used as the material for sacrificial layer 12.

Although it is detailed later, copper is used as the material for coil section 20 because copper is excellent in electrical conductivity, also excellent in forming electrode patterns by using the plating technique, and in productivity.

Figure 5:
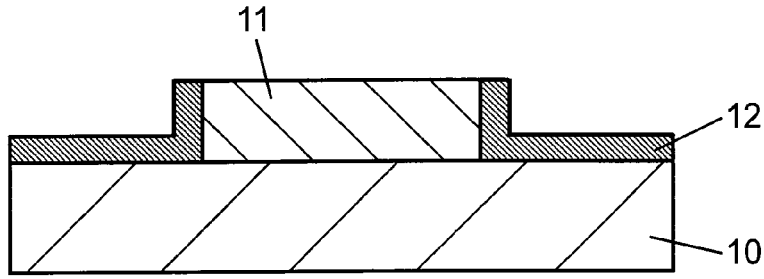
FIG. 5 shows a sectional view illustrating a method of manufacturing the inductance component in accordance with the first embodiment.

Then as shown in FIG. 5, remove unnecessary sections from sacrificial layer 12 so that the surface of epoxy resin 11 can be exposed and resin 11 can have a given height by using a grinding method or a CMP polishing method. After the removal, the metal film to be sacrificial layer 12 is formed on the surface of substrate 10 and lateral faces of epoxy resin 11. The foregoing specific surface and the lateral faces will not be used as base 1.

Figure 6:
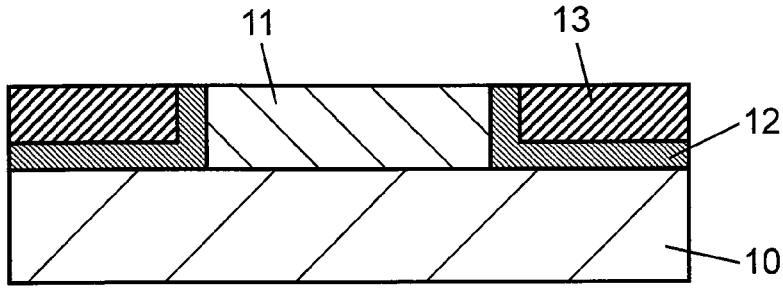
FIG. 6 shows a sectional view illustrating a method of manufacturing the inductance component in accordance with the first embodiment.
Figure 7:
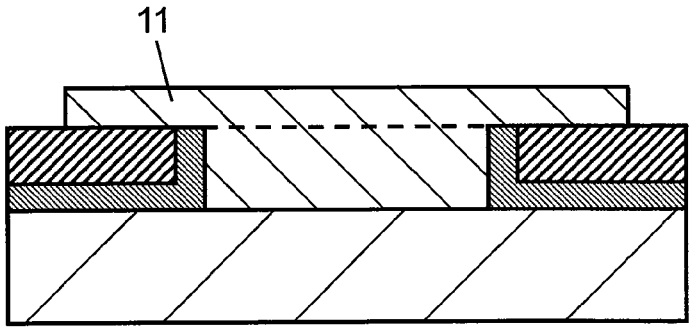
FIG. 7 shows a sectional view illustrating a method of manufacturing the inductance component in accordance with the first embodiment.
Figure 8:
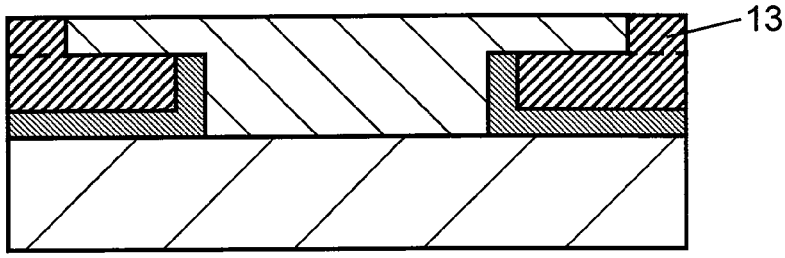
FIG. 8 shows a sectional view illustrating a method of manufacturing the inductance component in accordance with the first embodiment.

Next, as shown in FIG. 6, form copper electrode pattern 13 made of copper excellent in electrical conductivity into a given pattern by the plating technique. Then as shown in FIG. 7, apply again photosensitive epoxy resin 11 onto existing resin 11, and form a given pattern by using the photolithographic technique. Next, as shown in FIG. 8, layer the copper electrode pattern 13 to be first external electrode 40*a* by using the plating technique and the photolithographic technique.

Figure 9:
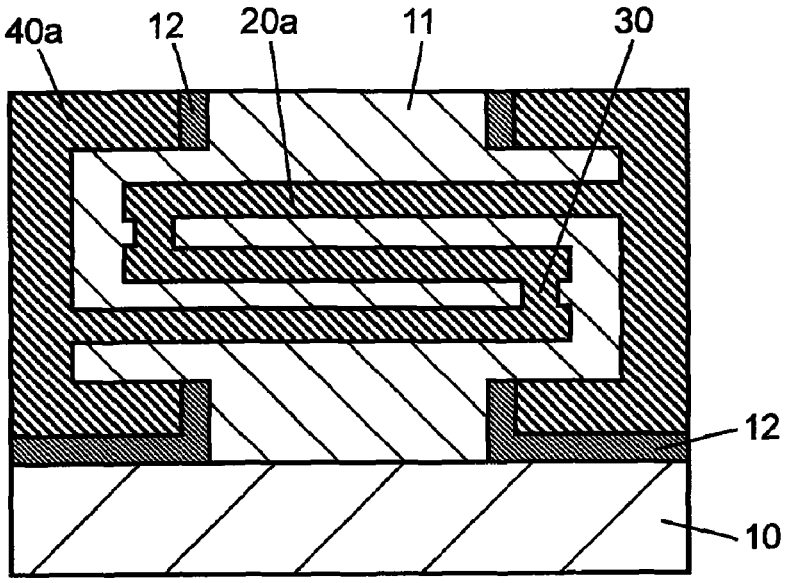
FIG. 9 shows a sectional view illustrating a method of manufacturing the inductance component in accordance with the first embodiment.

Next as shown in FIG. 9, repeat the steps discussed above for layering coil pattern 20*a*, via-electrodes 30, and first external electrode 40*a*. These elements layered on epoxy resin 11 are preferably formed by the electroless plating method or the electrolytic plating method. The copper electrode can be replaced with a silver electrode.

Form sacrificial layer 12 made of titan as the upper most layer of the foregoing layered body, and then form first external electrode 40*a* made of copper by the plating technique. However, sacrificial layer 12, i.e. the upper most layer, is not necessarily formed because it can be determined appropriately whether or not it is needed depending on a shape of the chip, the number of layers, and a degree of requirement of reliability.

Figure 10:
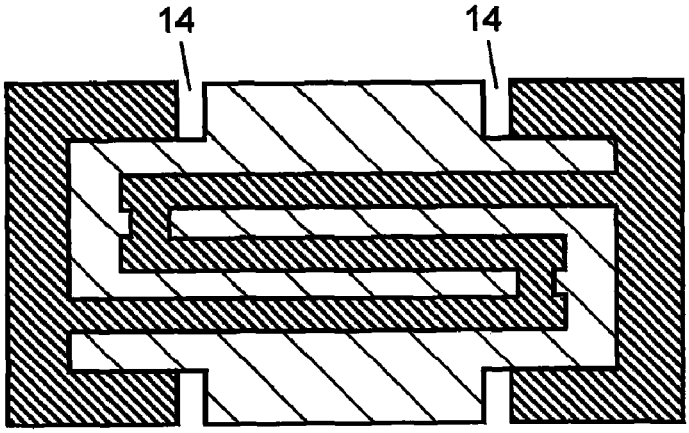
FIG. 10 shows a sectional view illustrating a method of manufacturing the inductance component in accordance with the first embodiment.

Then as shown in FIG. 10, after the formation of layered patterns of the inductance component, dissolve and remove silicon oxide by using etching liquid, e.g. fluoric acid, from the surface of substrate 10 made from silicon wafer and acting as the carrier. Since the fluoric acid does not attack copper but dissolves titan, space 14 to be stress buffering section 6 can be formed when substrate 10 is detached from the layered body which is to be the inductance component. Stress buffering section 6 is formed on the interface confronting the mounting face.

In FIG. 10, spaces 14 are formed on the upper and lower layers of the inductance component; however, space 14 can be formed only on the upper layer or the lower layer by the same manufacturing method. The method discussed above thus allows manufacturing the inductance component excellent in reliability.

Layering sacrificial layer 12 made of metallic film, or layering thermoplastic polyimide resin, or forming the material excellent in etching such as aluminum into a pattern dividable into pieces will allow the layered body to be divided into pieces. Use of a cutting machine will also allows the layered body to be mechanically divided.

Figure 11:
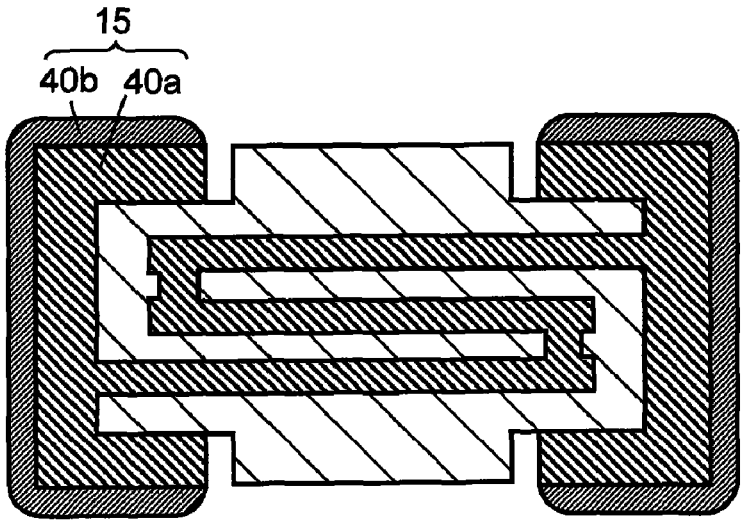
FIG. 11 shows a sectional view illustrating a method of manufacturing the inductance component in accordance with the first embodiment.
Figure 12:
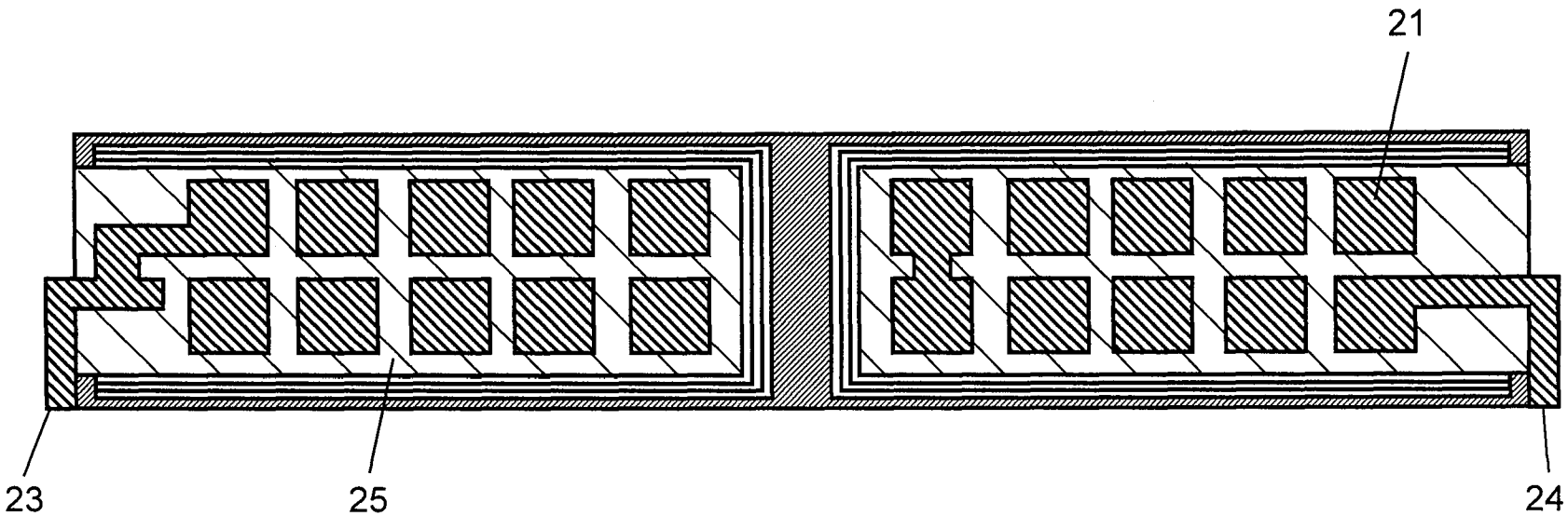
FIG. 12 Prior Art
FIG. 12 shows a sectional view of a conventional inductance component.
Figure 13:
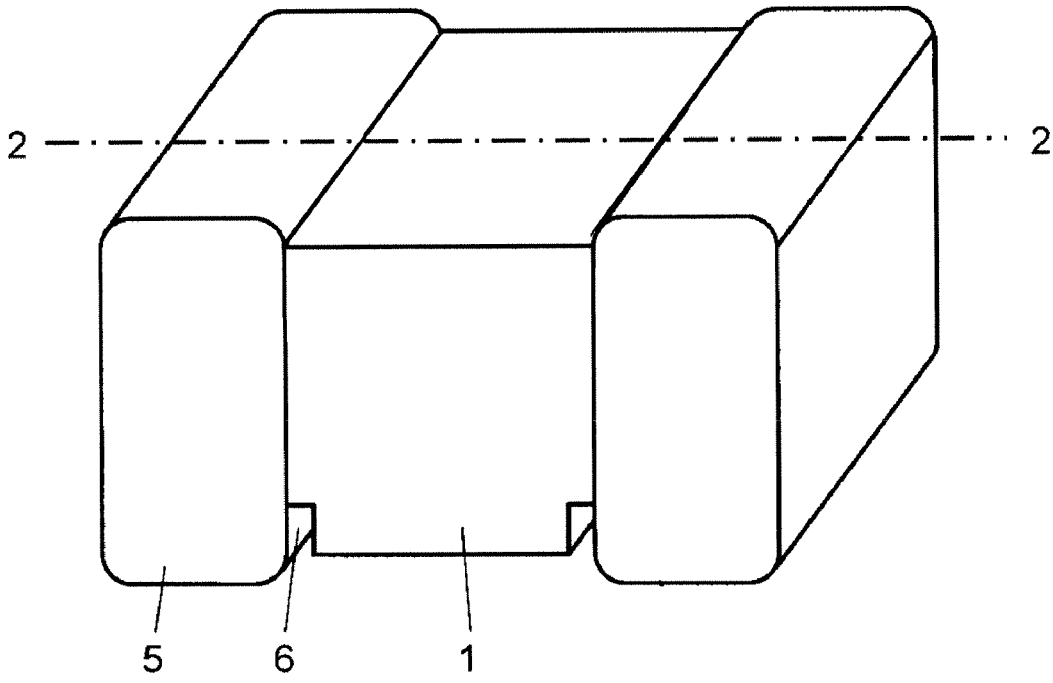
FIG. 13 shows a perspective view of an inductance component in accordance with another example of the present invention.

Then as shown in FIG. 11, form second external electrode 40*b* on the surface of first external electrode 40*a* of each piece of the inductance component by the barrel plating method. Solder or tin excellent in soldering wettability is used as the material for second external electrode 40*b*. The inductance component having external electrode terminal 15 excellent in mounting operation can be thus manufactured.

The method discussed above allows manufacturing the inductance component having given spaces 14, acting as stress buffering sections 6, on the interface between external electrode terminal 15 and base 1. The inductance component thus manufactured is highly reliable with respect to changes in stress such as warping.

INDUSTRIAL APPLICABILITY

The inductance component of the present invention is highly reliable with respect to the changes in stress caused by, e.g. thermal shock, so that the inductance component and the manufacturing method thereof are useful for a variety of electronic devices.

The invention claimed is:

1. An inductive component comprising:

a base made of insulating material;

a coil section buried in the base; and an external electrode terminal electrically connected to an end of the coil section, the external electrode terminal including a first external electrode contacting the base and a second terminal electrode covering the first external electrode, wherein:

a stress buffering section is provided between the base and the first external electrode, the stress buffering section includes a groove between the base and the first external electrode, and the first external electrode is exposed in the groove.

2. The inductive component of claim 1, wherein the stress buffering section is in a shape parallel with the exposed surface of the first external electrode.

3. The inductive component of claim 1, wherein the stress buffering section is provided at least on a face confronting a mounting face to be mounted on circuit board.

4. The inductive component of claim 1, wherein the stress buffering section has a V-shaped cross section.

5. The inductive component of claim 1, wherein the stress buffering section has a U-shaped cross section.

6. The inductive component of claim 1, wherein an angle included between a side of the first external electrode terminal, which confronts the stress buffering section, and a surface shape of the stress buffering section is an obtuse angle.

7. The inductive component of claim 1, wherein a side of the first external electrode, which confronts the stress buffering section, has a cross section of an arcing shape.

8. The inductive component of claim 1, wherein the stress buffering section is formed of buffer material having an elastic coefficient smaller than that of the base and that of the first external electrode.

9. The inductive component of claim 8, wherein the buffer material includes one of silicone resin, acrylic resin, polyethylene resin, polyester resin, and elastomer resin.

10. The inductive component of claim 1, wherein the body is made of resin.

11. The inductive component of claim 1, wherein the groove is formed only on a mounting face of the inductive component.

12. The inductive component of claim 1, wherein the groove is formed only on a mounting face of the inductive component and an opposite face to the mounting face of the inductive component.

13. The inductive component of claim 1, wherein the coil section comprises a plurality of coil patterns and via-electrodes connecting the coil patterns.

* * * * *